US008904941B2

(12) United States Patent
Lee

(10) Patent No.: US 8,904,941 B2
(45) Date of Patent: Dec. 9, 2014

(54) AMMUNITION

(75) Inventor: Se-Yup Lee, Seoul (KR)

(73) Assignee: Korea Nuclear Engineering Co., Ltd., Seongnam-si, Gyeonggi-do (KR)

( * ) Notice: Subject to any disclaimer, the term of this patent is extended or adjusted under 35 U.S.C. 154(b) by 0 days.

(21) Appl. No.: 13/980,825

(22) PCT Filed: Jan. 25, 2012

(86) PCT No.: PCT/KR2012/000583

§ 371 (c)(1),
(2), (4) Date: Jul. 19, 2013

(87) PCT Pub. No.: WO2012/105765

PCT Pub. Date: Aug. 9, 2012

(65) Prior Publication Data

US 2013/0284045 A1 Oct. 31, 2013

(30) Foreign Application Priority Data

Feb. 1, 2011 (KR) ..... 10-2011-0009908

(51) Int. Cl.

| | |
|---|---|
| ***F42B 30/00*** | (2006.01) |
| ***F42B 10/44*** | (2006.01) |
| ***F42B 5/02*** | (2006.01) |
| ***F42B 14/02*** | (2006.01) |
| ***F42B 7/08*** | (2006.01) |

(52) U.S. Cl.

CPC . *F42B 5/02* (2013.01); *F42B 10/44* (2013.01); *F42B 14/02* (2013.01); *F42B 7/08* (2013.01)

USPC ..... 102/439; 102/532

(58) Field of Classification Search

CPC ..... F42B 5/02; F42B 5/025; F42B 5/067; F42B 5/073; F42B 7/08; F42B 14/02

USPC ..... 102/439, 501, 517, 520, 521, 524, 525, 102/526, 527, 528, 532

See application file for complete search history.

(56) References Cited

U.S. PATENT DOCUMENTS

| | | | | | |
|---|---|---|---|---|---|
| 193,657 | A | * | 7/1877 | Hotchkiss | 102/525 |
| 225,454 | A | * | 3/1880 | Coloney | 74/598 |
| 487,125 | A | * | 11/1892 | Latouche | 102/430 |
| 1,166,360 | A | * | 12/1915 | Gregory | 102/430 |

(Continued)

FOREIGN PATENT DOCUMENTS

KR 100843573 B1 7/2008

*Primary Examiner* — Gabriel Klein

(74) *Attorney, Agent, or Firm* — Novick, Kim & Lee, PLLC; Jae Youn Kim

(57) ABSTRACT

An ammunition capable of improving flying speed, shooting range, flight velocity, and straightness of a bullet by reducing the air resistance of the bullet due to the eddy flow of air generated at the rear portion of the bullet is provided. The wad of the ammunition includes a pressing portion having a through hole in which the cylindrical surface of the bullet is inserted, a coupling surface closely contacted to the vertical surface of the bullet, and a pressing surface extending from the through hole; and a cover portion having an inner peripheral surface which extends from the coupling surface of the pressing portion in the thrust force acting direction to cover a part of the circumferential surface of the streamlined tail portion of the bullet, and an outer peripheral surface which extends from an outer periphery of the pressing portion substantially parallel to the cylindrical surface of the bullet.

9 Claims, 4 Drawing Sheets

(56) References Cited

U.S. PATENT DOCUMENTS

| | | | | | |
|---|---|---|---|---|---|
| 1,746,397 | A * | 2/1930 | Johnson | 102/439 |
| 2,045,933 | A * | 6/1936 | Townsend | 384/49 |
| 2,055,765 | A * | 9/1936 | Hayden | 244/3.25 |
| 2,389,846 | A * | 11/1945 | Ericson | 102/523 |
| 2,911,911 | A * | 11/1959 | White | 102/439 |
| 4,301,737 | A | 11/1981 | Yuhash et al. | |
| 4,708,063 | A * | 11/1987 | Ladriere | 102/516 |
| 6,763,765 | B2 * | 7/2004 | Crowson | 102/522 |
| 7,096,791 | B2 * | 8/2006 | Vanmoor | 102/501 |
| 7,845,281 | B2 | 12/2010 | Sexton | |
| 8,485,100 | B2 * | 7/2013 | Lee | 102/430 |
| 2002/0134273 | A1 * | 9/2002 | Mihaylov et al. | 102/439 |
| 2005/0229807 | A1 | 10/2005 | Brock et al. | |

* cited by examiner

AMMUNITION

TECHNICAL FIELD

The present invention relates to an ammunition, and more particularly, to an ammunition capable of increasing flying speed and shooting range of a bullet, as well as improving flight velocity and straightness of a bullet by reducing the air resistance of the bullet due to the eddy flow of air generated at the rear portion of the bullet.

BACKGROUND ART

In general, an ammunition includes a case having an opening portion formed at a front end thereof and a propellant chamber filled with a propellant therein, a bullet inserted in the opening portion of the case, and a primer installed in a rear base of the case.

In such an ammunition, when an impact acts on a primer in the rear case due to a percussion lock, the propellant within the case is exploded by the impact. At this moment, the bullet is propelled forward at high velocity by the explosive power of the propellant, and the propelled bullet flies forward to reach a target point.

Since a conventional ammunition is configured to have a planar rear portion of the bullet in order to receive the explosive power of the propellant as much as possible, eddy flow of air is generated at the planar rear portion of the bullet during flight, thereby increasing the air resistance against the bullet. As a result, the flying speed of the bullet is decreased, and the shooting range thereof is shortened. Further, a hit ratio is decreased due to increasing of an error between an aiming point and an impact point by lowering the linearity of bullet.

In order to improve the above-described problems, the present applicant has proposed an ammunition in Korean Patent Registration No. 10-0843573. The proposed ammunition includes a streamlined tail portion so as to minimize the air resistance against the rear portion of the bullet, and a wad separately coupled to the streamlined tail portion of the bullet to apply a thrust force to the bullet when the propellant is exploded.

According to the ammunition with such a configuration, the wad provides a thrust force to the bullet by a pressure due to an explosion of the propellant within the propellant chamber to push out the bullet therefrom, and is separated from the bullet when the bullet exits the muzzle. Therefore, only the bullet is propelled forward with a high thrust force. In this case, the streamlined tail portion of the bullet minimizes the frictional resistance with ambient air during flight and prevents the eddy flow at the rear portion of the bullet, so that flight velocity and straightness are improved to lengthen the shooting range and reduce the error between the aiming point and impact point so as to improve the hit ratio.

However, the coupling structure of the wad installed on the streamlined tail portion of the bullet is of an inclined structure gradually expanding in the thrust force acting direction of the wad, and the bullet is made of a soft material such as copper alloy, whereas the wad is made of a hard material such as iron or stainless steel that are harder than the copper alloy. Therefore, a press fitting phenomenon, in which the wad is pushed in and fitted tightly as the streamlined tail portion of the soft bullet is compressed when the strong thrust force of the wad by the explosion pressure of propellant is acting, occurs frequently. If such a press fitting phenomenon occurs, the wad won't be separated properly from the bullet when the bullet exits the muzzle, so that the firing performance is lowered.

DISCLOSURE

Technical Problem

In consideration of the above-mentioned circumstances, it is an object of the present invention to provide an ammunition in which the explosion pressure of propellant can act on the bullet with a strong thrust force and also a wad is reliably separated from the bullet when the bullet exits the muzzle so that the bullet can maintain excellent firing performance.

Technical Solution

In order to accomplish the object, there is provided an ammunition including: a case having an opening portion formed at a front end thereof and a propellant chamber formed to be filled with a propellant therein; a primer installed in the case to explode the propellant filled in the propellant chamber of the case; a bullet which is separately fitted in the case to seal the opening portion with a body portion thereof, and which has a streamlined tail portion formed in a rear of the body portion to minimize air resistance when the bullet is shot; and a wad separately mounted on the streamlined tail portion of the bullet to apply a thrust force to the bullet when the propellant is exploded, wherein the bullet includes a horizontal cylindrical surface formed on a middle portion of the streamlined tail portion in a thrust force acting direction of the wad along a circumferential direction, and a vertical surface extending from one side of the cylindrical surface in a direction orthogonal to the thrust force acting direction, and the wad includes a pressing portion having a through hole in which the cylindrical surface of the bullet is inserted, a coupling surface closely contacted to the vertical surface of the bullet, and a pressing surface extending from the through hole in the direction orthogonal to the thrust force acting direction; and a cover portion having an inner peripheral surface which extends from the coupling surface of the pressing portion in the thrust force acting direction to cover a part of the circumferential surface of the streamlined tail portion of the bullet, and an outer peripheral surface which extends from an outer periphery of the pressing portion substantially parallel to the cylindrical surface of the bullet.

Preferably, the ammunition further includes a reinforcing body which is integrally coupled at a part of the streamlined tail portion including a part of the cylinder surface to be inserted in the through hole of the wad and the vertical surface of the streamlined tail portion, and made of a metal harder than the material of the bullet.

Preferably, the ammunition further includes a reinforced body which is integrally coupled to a part of the outer peripheral surface of the streamlined tail portion, and made of a metal harder than the material of the bullet, wherein reinforced body includes a cylindrical surface inserted in the through hole, and a vertical surface contacting with the coupling surface of the wad.

Preferably, the reinforced body includes a plurality of cylinder surfaces inserted in corresponding through holes, and a plurality of vertical surface contacting with corresponding coupling surfaces of the wad.

Preferably, a diameter of the outer peripheral surface of the cover portion provided in the wad is formed smaller than a diameter of the body portion of the bullet.

Preferably, the wad includes a first sloping surface which is formed on the inner peripheral surface of the cover portion of the wad in an upward sloping shape tapered toward a distal end thereof from the outer peripheral surface of the streamlined tail portion, and a second sloping surface which is formed on the outer peripheral surface of the cover portion of the wad in a downward sloping shape tapered toward the distal end thereof from a middle part of the outer peripheral surface.

Advantageous Effects

According to the ammunition of the present invention, the pressing surface of the wad receiving the explosion pressure of the propellant is formed so as to be orthogonal to the thrust force acting direction, and the vertical surface formed in the streamlined tail portion of the bullet and the coupling surface of the wad adhering to the vertical are formed so as to be perpendicular to the thrust force acting direction of the wad. Therefore, a strong thrust force can act on the bullet, and when the thrust force acts due to the assembly structure of such a streamlined tail portion and the wad, the press fitting phenomenon in which the assembled portion of the bullet and the wad is fitted in tightly does not occur. Therefore, when the bullet exits the muzzle, the wad can be reliably separated from the bullet.

Further, according to the present invention, a part of the streamlined tail portion of the bullet contacting with the wad is provided with a reinforcing body which is made of metal harder than the material of the bullet and is integrally fitted to the streamlined tail portion. Therefore, the vertical surface of the streamlined tail portion receiving a strong pressing force by the thrust force action of the wad is prevented from being deformed, so the strong thrust force of the wad can be reliably transmitted to the bullet.

Further, according to the present invention, the diameter of the outer peripheral surface of the cover portion included in the wad is formed smaller than the diameter of the body portion of the bullet. Therefore, the outer peripheral surface of the wad does come into contact with the opening portion of the case or the rifling of the gun barrel, so frictional resistance can be minimized.

Further, according to the present invention, a first sloping surface is formed on the inner peripheral surface of the cover portion of the wad. Therefore, when the bullet exits the muzzle, the air flowing along the surface of the bullet is introduced into the first sloping surface to push the wad in the direction separating from the bullet, so the wad can be separated more reliably from the bullet.

Further, according to the present invention, a second sloping surface is formed on the outer peripheral surface of the cover portion of the wad. Therefore, slipping is induced even in the case that the outer peripheral surface of the wad comes into contact with the opening portion of the case or the rifling of the gun barrel when the bullet is shot, so that frictional resistance therebetween can be minimized.

BEST MODE

Hereinafter, preferred embodiments of the present invention will be described in detail with reference to the accompanying drawings.

Figure 1:
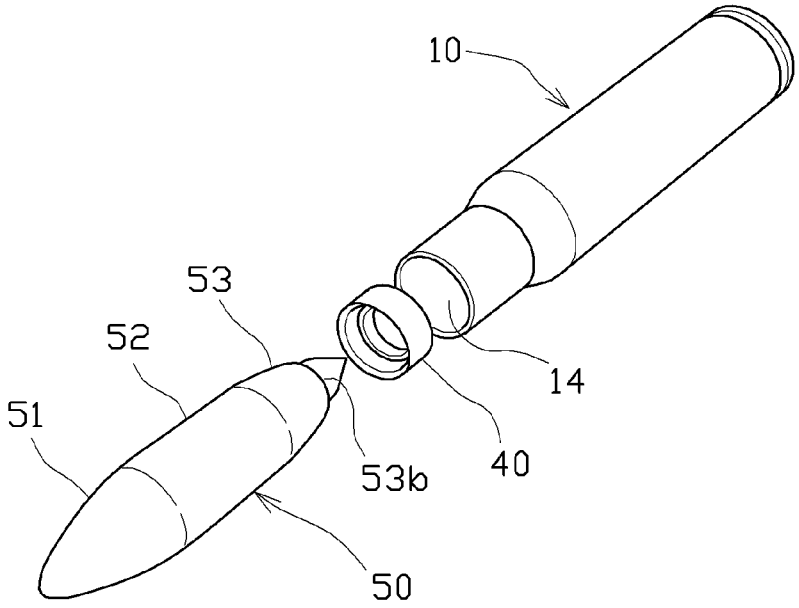
FIG. 1 is an exploded perspective view of an ammunition according to an embodiment the present invention.
Figure 2:
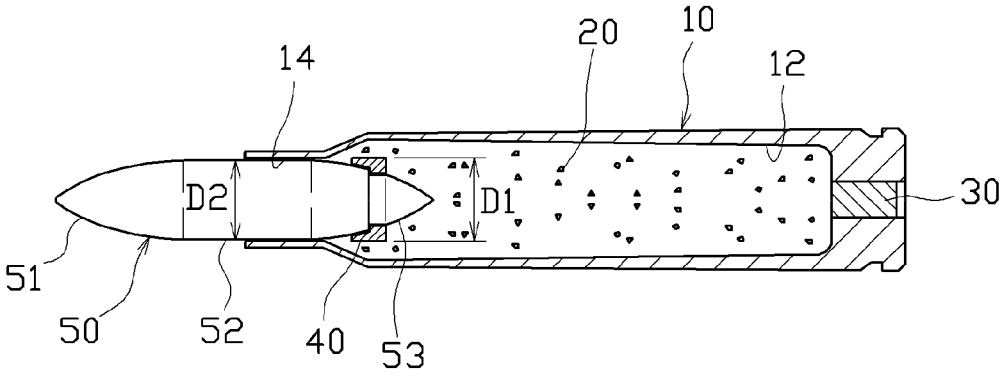
FIG. 2 is a cross sectional view of the ammunition according to the embodiment of the present invention.

As shown in FIGS. 1 and 2, an ammunition of the present invention includes a cylindrical case 10.

The case 10 includes a propellant chamber 12 having an opening portion formed at the front end thereof for filling propellant 20 and a rear base formed at the rear end thereof. Propellant 20 is filled in the propellant chamber 12 to explode by an impact applied thereto.

A primer 30 is inserted in the rear base of the case 10. The primer 30 is detonated upon receiving a physical or electrical impact applied thereto by a percussion lock of firearms or cannons. In this case, a detonating force generated by the primer 30 is transferred to the propellant 20 so as to induce the propellant 20 to explode within the case 10.

A bullet 50 is inserted in the opening portion 14 of the case 10 to be separated by firing, and includes a wad 40 which is separately mounted on a rear end portion of the bullet 50. The wad 40 applies a thrust force to the bullet 50 when the propellant 20 is exploded.

The bullet 50 includes a conical head portion 51, a cylindrical body portion 52, and a streamlined tail portion 53 formed on a rear side of the body portion 52.

The body portion 52 of the bullet 50 is separately inserted in the opening portion 14 so as to seal the propellant chamber 12. The body portion 52 is forcibly press fitted in the opening portion 14 so that this portion is fixed in the opening portion 14. In particular, the body portion is separately fixed in the opening portion from the case 10 when the propellant 20 is exploded.

The streamlined tail portion 53 of the bullet 50 is configured to minimize frictional resistance with air when the bullet is shot, and generate a laminar flow so that the airflow around the bullet 50 flows regularly in a laminar flow state. Therefore, the eddy flow of air generated at the rear portion of the bullet 50 is prevented by the tail portion.

Figure 3:
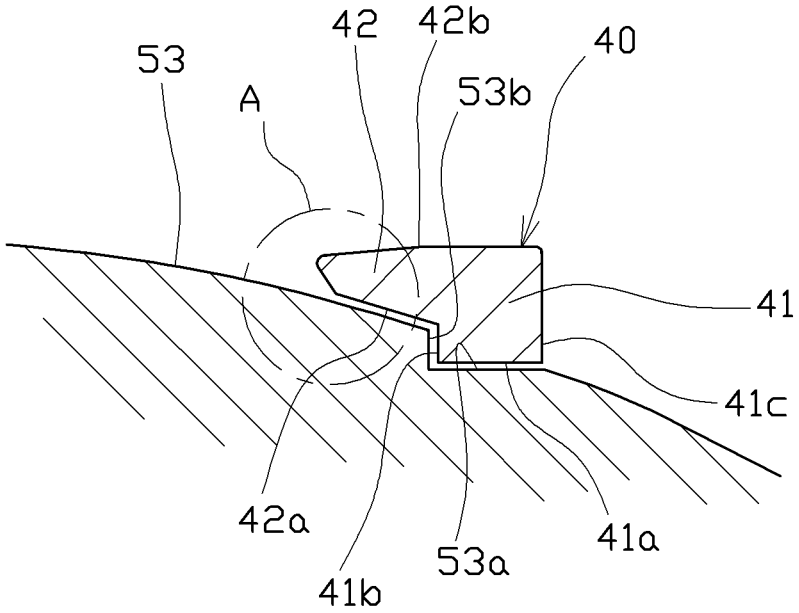
FIG. 3 is a cross sectional view illustrating a major part of the ammunition according to the embodiment of the present invention in detail.

Meanwhile, as shown in FIG. 3, the bullet 50 includes a horizontal cylindrical surface 53*a* which is formed on a middle portion of the streamlined tail portion 53 in a thrust force acting direction of the wad 40 along a circumferential direction, and a vertical surface 53*b* extending from one side of the cylindrical surface 53*a* in a direction orthogonal to the thrust force acting direction of the wad 40.

The wad 40 which is fitted to a rear portion of the bullet 50, that is the tail portion 53 includes a pressing portion 41 to which the explosion pressure of the propellant 20 is applied, and a cover portion 42 which covers a peripheral surface of the streamlined tail portion 53.

The pressing portion 41 of the wad 40 includes a through hole 41*a* in which the cylindrical surface 53*a* of the tail portion 53 is inserted, a coupling surface 41*b* contacting with the vertical surface 53*b* of the tail portion 53, and a pressing surface 41*c* extending from the through hole 41*a* in the direction orthogonal to the thrust force acting direction.

The cover portion 42 of the wad 40 is extended from an end of the pressing portion 41 in the thrust force acting direction of the wad 40, and includes an inner peripheral surface 42*a* which covers a part of the circumferential surface of the streamlined tail portion 53 of the bullet 50, and an outer peripheral surface 42*b* which extends from an outer periphery of the pressing portion 41 substantially parallel to the cylindrical surface 53*a* of the bullet 50. Preferably, as shown in FIG. 2, a diameter D1 of the outer peripheral surface 42*b* of the cover portion 42 of the wad 40 is smaller than a diameter D2 of the body portion 52 of the bullet 50 so as to minimize frictional contact between the outer peripheral surface 42*b* of the wad 40 and the case 10 of a rifling of the gun barrel when the bullet is shot.

Figure 4:
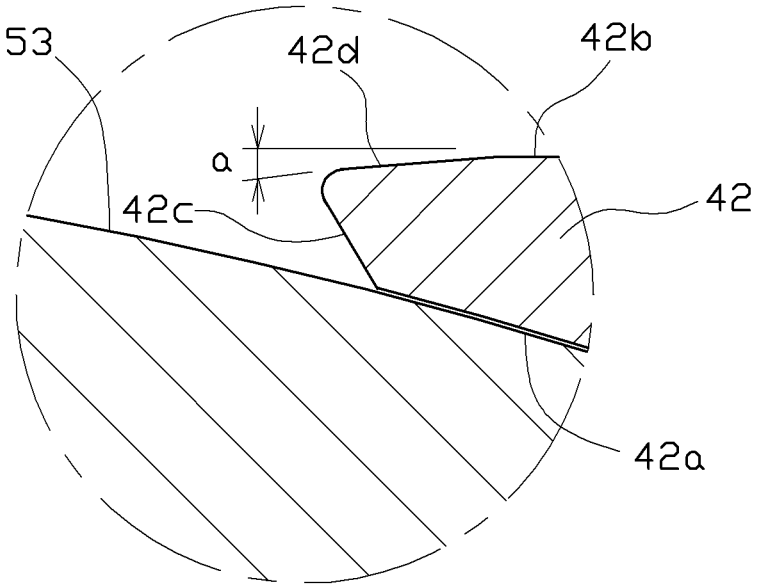
FIG. 4 is an enlarged cross sectional view of part A in FIG. 3.

Preferably, as shown in FIG. 4, the wad 40 includes a first sloping surface 42*c* which is formed on the inner peripheral surface 42*a* of the cover portion 42 of the wad 40 in an upward sloping shape tapered toward a distal end thereof from the outer peripheral surface of the streamlined tail portion 53. Therefore, when the bullet is shot and exits the muzzle, the wad 40 is pushed by air applied through the first sloping surface 42*c* so that the wad 40 can be easily separated from the bullet 50. Further, the wad 40 includes a second sloping surface 42*d* which is formed on the outer peripheral surface 42*b* of the cover portion 42 of the wad 40 in a downward sloping shape tapered toward the distal end thereof from a middle part of the outer peripheral surface 42*b*. When the outer peripheral surface 42*b* of the bullet 50 is in contact with the case 10 of the rifling after the bullet is shot, sliding is generated between these parts by the second sloping surface 42*d* so that the frictional resistance therebetween can be minimized.

Meanwhile, when the vertical surface 53*b* of the streamlined tail portion 53 inserted in the through hole 41*a* of the wad 40 is made of a soft material such as copper alloy, whereas the wad 40 is made of a hard material such as iron or stainless steel that are harder than the copper alloy, there is a risk that the vertical surface 53*b* of the streamlined tail portion 53 is deformed by a strong thrust force of the wad 40 transferred to the bullet 50.

Figure 5:
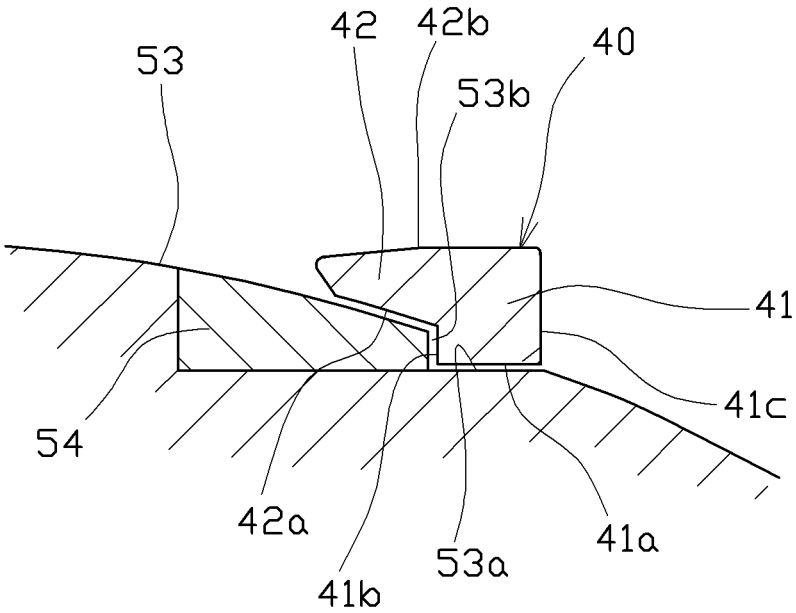
FIG. 5 is a cross sectional view illustrating a major part of an ammunition according to a modified embodiment of the present invention in detail.

Therefore, as shown in FIG. 5, the ammunition further includes a reinforced body 54 which is disposed at a part of the streamlined tail portion 53 including a part of the cylinder surface 53*a* to be inserted in the through hole of the wad 40 and the vertical surface of the streamlined tail portion 53, and which includes a vertical surface 53*b*. Preferably, the reinforced body 54 is made of a hard metal such as iron or stainless steel similar to the wad 40 that are harder than the material of the bullet 50, and integrally fitted to the streamlined tail portion 53.

Figure 6:
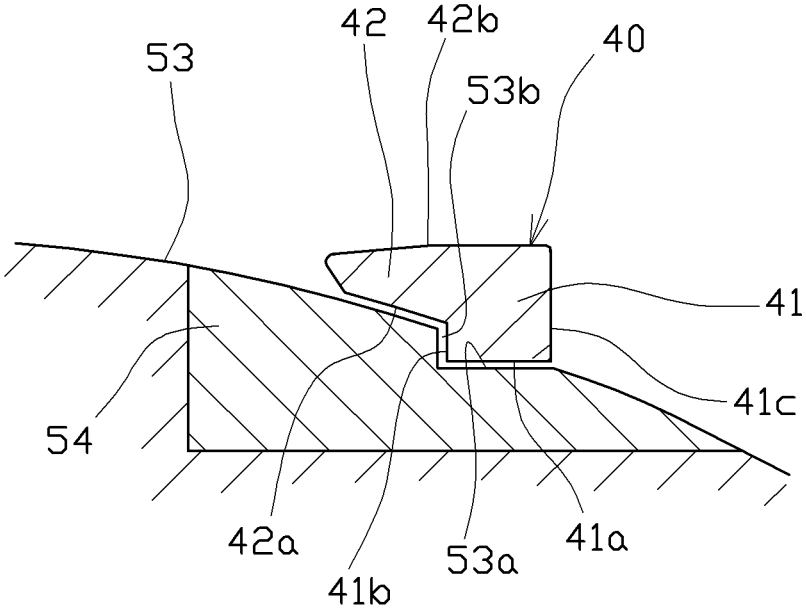
FIG. 6 is a cross sectional view illustrating a major part of an ammunition according to another modified embodiment of the present invention in detail.

FIG. 6 is a cross sectional view illustrating a reinforced body 54 according to a modified embodiment of the present invention. As shown in FIG. 6, the reinforced body 54 disposed at a part of the outer peripheral surface of the streamlined tail portion 53 includes a cylindrical surface 53*a* inserted in the through hole of the wad 40, and a vertical surface 53*b* contacting with the coupling surface of the wad.

Figure 7:
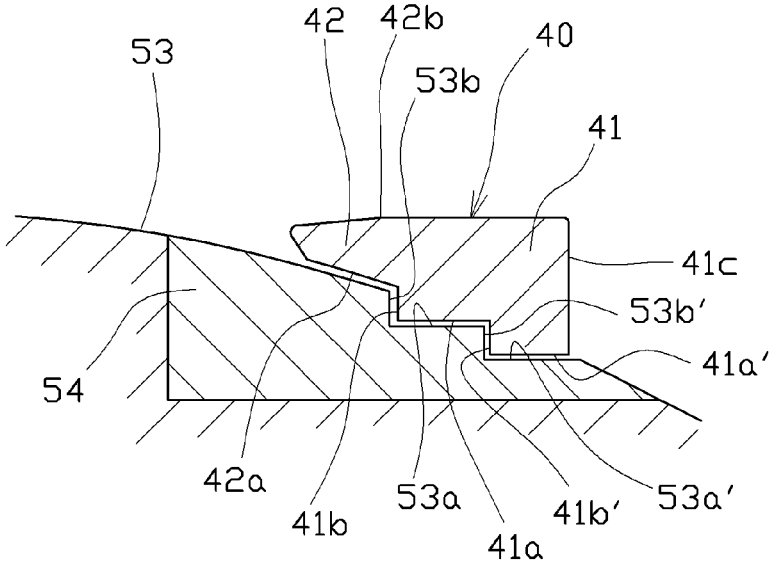
FIG. 7 is a cross sectional view illustrating a major part of an ammunition according to another modified embodiment of the present invention in detail.

As shown in FIG. 7, the reinforced body 54 disposed at a part of the outer peripheral surface of the streamlined tail portion includes a plurality of cylinder surfaces 53*a* and 53*a*' inserted in corresponding through holes 41*a* and 41*a*' of the wad 40 are mounted, and a plurality of vertical surfaces 53*b* and 53*b*' contacting with corresponding coupling surfaces 41*b* and 41*b*' of the wad 40.

Next, an operation of the ammunition having the above configuration will be described. First, after load the ammunition on firearms or cannon, if a physical or electrical impact is applied to the primer 30 of the ammunition by activating the percussion lock, the impacted primer 30 is detonated to explode the propellant 20 filled in the propellant chamber 12. Then, the pressing surface 41*c* of the wad 40 coupled to the streamlined tail portion 53 of the bullet 50 is pushed by the explosion pressure of the propellant so that a thrust force that propels the bullet 50 acts on the pressing surface 41*c* of the wad 40.

Since the pressing surface 41*c* of the wad 40 is formed to be orthogonal to the thrust force acting direction of the wad 40 for maximally receiving the explosion pressure of the propellant, the pressing surface 41*c* can apply a strong thrust force to the bullet 50 by the explosion pressure.

Since the vertical surface 53*b* provided in the streamlined tail portion 53 of the bullet 50 and the coupling surface 41*b* of the wad 40 contacting therewith are formed to be orthogonal to the thrust force acting direction of the wad 40, the strong thrust force of the wad 40 is maximally transferred to the bullet 50. Therefore, the bullet 50 can be fired by the strong thrust force.

Figure 8:
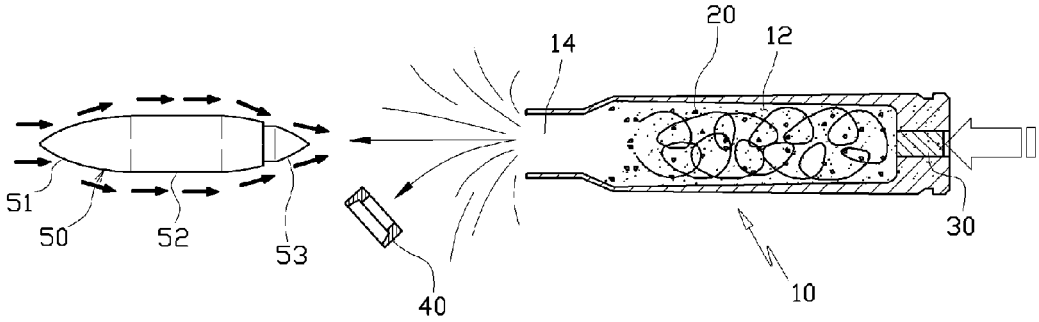
FIG. 8 is a view for describing an operation state of the ammunition according to the embodiment of the present invention.

Further, in the coupling structure of the streamlined tail portion 53 of the bullet 50 and the wad 40, since the horizontal cylindrical surface 53*a* formed in the thrust force acting direction of the wad 40 is inserted in the through hole 41*a* of the wad 40, and the coupling surface 41*b* of the wad 40 is closely contacted to the vertical surface 53*b* orthogonal to the thrust force acting direction of the wad 40, the press fitting phenomenon in which the wad 40 and the streamlined tail portion 53 of the bullet 50 is fitted in tightly does not occur. Therefore, as shown in FIG. 8, the wad 40 can be reliably separated from the bullet 50 when the bullet 50 exits the muzzle.

In addition, since the diameter D1 of the outer peripheral surface 42*b* of the cover portion 42 of the wad 40 is smaller than the diameter D2 of the body portion 52 of the bullet 50, the outer peripheral surface 42*b* of the wad 40 does come into contact with the opening portion of the case 10 of the rifling of the gun barrel when the bullet 50 is shot, so that the frictional resistance can be minimized when the bullet 50 is shot.

Further, since the second sloping surface 42*d* is formed in the outer peripheral surface end portion 42*b* of the cover portion of the wad 40, slipping is induced even in the case that the outer peripheral surface 42*b* of the wad 40 comes into contact with the opening portion of the case or the rifling of the gun barrel when the bullet is shot, so that the frictional resistance therebetween can be minimized.

Further, since the first sloping surface 42*c* is formed in the inner peripheral surface end portion 42*a* of the cover portion 42 of the wad 40, when the bullet 50 exits the muzzle, the air flowing along the surface of the bullet 50 is introduced into the first sloping surface 42*c* to push the wad 40 in the direction separating from the bullet 50. Therefore, the wad 40 is more reliably separated from the bullet 50 so that the bullet 50 can maintain excellent firing performance.

Although the present invention has been described in connection with the exemplary embodiments illustrated in the drawings, it is only illustrative. It will be understood by those skilled in the art that various modifications and equivalents can be made to the present invention. Therefore, the true technical scope of the present invention should be defined by the appended claims.

The invention claimed is:

1. An ammunition comprising: a case having an opening portion formed at a front end thereof and a propellant chamber formed to be filled with a propellant therein; a primer installed in the case to explode any propellant filled in the propellant chamber of the case; a bullet which is separately fitted in the case and includes a body portion to seal the opening portion and a streamlined tail portion extending rearward from the body portion to minimize air resistance when the bullet is shot; and a wad separately mounted on the streamlined tail portion of the bullet to apply a thrust force to the bullet when the propellant is exploded, wherein the streamlined tail portion includes a generally frustoconical circumferential surface contiguous with the body portion, a horizontal cylindrical surface formed on a middle portion of the streamlined tail portion, an annular vertical surface extending radially outward from one end of the cylindrical surface and extending radially inward from one end of the circumferential surface, and a generally conical tail surface extending to a rear end of the bullet, and the wad includes a pressing portion having a through hole in which the cylindrical surface of the bullet is inserted, a coupling surface abutting the vertical surface of the bullet, and a pressing surface extending from the through hole in a direction radially outward from the cylindrical surface of the bullet; the wad further including a cover portion having an inner peripheral surface which extends from the coupling surface of the pressing portion toward the body portion of the bullet to cover a part of the circumferential surface of the streamlined tail portion of the bullet, and an outer peripheral surface which extends from an outer periphery of the pressing portion substantially parallel to the cylindrical surface of the bullet.

2. The ammunition according to claim 1, further comprising a reinforcing body integrally forming a part of the streamlined tail portion and defining the vertical surface and part of the circumferential surface, and made of a metal harder than the material of the bullet.

3. The ammunition according to claim 1, further comprising a reinforcing body integrally forming a part of the streamlined tail portion and defining the vertical surface, the cylindrical surface, a part of the circumferential surface, and made of a metal harder than the material of the bullet.

4. The ammunition according to claim 3, wherein the reinforced body includes a plurality of cylindrical surfaces inserted in corresponding through holes of the wad, and a plurality of vertical surfaces contacting with corresponding coupling surfaces of the wad.

5. The ammunition according to claim 1, wherein a diameter of the outer peripheral surface of the cover portion of the wad is formed smaller than a diameter of the body portion of the bullet.

6. The ammunition according to claim 1, wherein the wad includes a first sloping surface which is formed on the inner peripheral surface of the cover portion of the wad in an upward sloping direction toward a distal end thereof.

7. The ammunition according to claim 6, wherein the wad includes a second sloping surface which is formed on the outer peripheral surface of the cover portion of the wad in a downward sloping shape tapered toward the distal end thereof from a middle part of the outer peripheral surface.

8. The ammunition according to claim 5, wherein the wad includes a first sloping surface which is formed on the inner peripheral surface of the cover portion of the wad in an upward sloping direction toward a distal end thereof.

9. The ammunition according to claim 8, wherein the wad includes a second sloping surface which is formed on the outer peripheral surface of the cover portion of the wad in a downward sloping shape tapered toward the distal end thereof from a middle part of the outer peripheral surface.

* * * * *